US008414206B2

(12) United States Patent
Asada

(10) Patent No.: US 8,414,206 B2
(45) Date of Patent: Apr. 9, 2013

(54) SHEET CONVEYING DEVICES AND DUPLEX RECORDING DEVICES

(75) Inventor: Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1162 days.

(21) Appl. No.: 12/053,575

(22) Filed: Mar. 22, 2008

(65) Prior Publication Data

US 2008/0240823 A1 Oct. 2, 2008

(30) Foreign Application Priority Data

Mar. 29, 2007 (JP) ..... 2007-087607

(51) Int. Cl.

| | |
|---|---|
| ***B41J 3/60*** | (2006.01) |
| ***B41J 13/10*** | (2006.01) |
| ***B65H 15/00*** | (2006.01) |
| ***B65H 85/00*** | (2006.01) |

(52) U.S. Cl.

USPC ..... 400/188; 400/624; 400/629; 400/642; 271/3.14; 271/291

(58) Field of Classification Search ..... 271/9.11, 271/9.07, 9.08, 3.14, 291, 65, 186; 400/149, 400/188, 624, 629, 646, 647

See application file for complete search history.

(56) References Cited

U.S. PATENT DOCUMENTS

| | | | | |
|---|---|---|---|---|
| 4,958,825 | A * | 9/1990 | Onomoto et al. | 271/119 |
| 6,659,444 | B2 * | 12/2003 | Kawarama | 271/9.09 |
| 7,725,071 | B2 * | 5/2010 | Izuchi et al. | 399/401 |
| 2006/0285904 | A1 * | 12/2006 | Yoshida | 399/401 |

FOREIGN PATENT DOCUMENTS

| | | | |
|---|---|---|---|
| JP | 57067431 | A * | 4/1982 |
| JP | 11209008 | A * | 8/1999 |
| JP | H11-209008 | A | 8/1999 |
| JP | 2004269124 | A * | 9/2004 |

* cited by examiner

*Primary Examiner* — Daniel J Colilla

(74) *Attorney, Agent, or Firm* — Baker Botts L.L.P.

(57) ABSTRACT

The invention describes a sheet conveying device having a feed tray for storing sheets, a first conveying path for conveying a first sheet in a first direction, a feed roller that feeds the sheets in the feed tray to the first conveying path, a second conveying path that connects the first conveying path and the feed tray, and conveys the first sheet in a direction opposite the first direction, and a multiple feed guide in the second conveying path, which has a guide for guiding the first sheet between the feed roller and the feed tray, and an overlying portion which overlies the feed tray on one side of the feed roller. The feed roller feeds the first sheet that was fed to the first conveying path, and was guided by the multiple feed guide, back to the first conveying path. A duplex printer incorporates this sheet conveying device.

16 Claims, 6 Drawing Sheets

SHEET CONVEYING DEVICES AND DUPLEX RECORDING DEVICES

CROSS-REFERENCE TO RELATED APPLICATION

The present application claims priority from Japanese Patent Application Publication No. JP-2007-087607, which was filed on Mar. 29, 2007, the disclosure of which is incorporated herein by reference in its entirety.

BACKGROUND OF THE INVENTION

1. Field of the Invention

This application relates to a sheet conveying device that feeds a sheet, e.g., a recording sheet or a document, multiple times through the sheet conveying device, and to a duplex recording device including the sheet conveying device.

2. Description of Related Art

Known duplex recording devices, such as those described in Japanese Unexamined Patent Application Publication No. H11-209008 A may record on both sides of a recording sheet by feeding a recording sheet using a feed roller to a conveying path and by again feeding the recording sheet using the same feed roller to the conveying path. Known printing devices may have a feed roller disposed above a feed tray. In the feed tray, a sheet holder for holding recording sheets is biased upwards by a spring. Therefore, the recording sheets held in the feed tray are pushed against the feed roller. In this state, forward rotation of the feed roller causes the recording sheets to be fed from the feed tray to a conveying path. A recording unit records an image onto one side of the recording sheet as the recording sheet is conveyed along the conveying path.

This printing device also has a sheet feed guide along which the recording sheet having the image recorded on one side thereof is conveyed in the reverse direction. The sheet feed guide is inclined from a downstream side of the recording unit in the conveying path towards one end of the feed tray, which is adjacent to the feed roller. The recording sheet guided by the sheet feed guide is conveyed to a position between the feed roller and the recording sheets in the feed tray. Forward rotation of the feed roller causes the recording sheet guided by the sheet feed guide to be fed to the conveying path. The recording sheet is flipped over while being conveyed in the conveying path. Then, an image is recorded on the reverse side of the recording sheet by the recording unit, and the recording sheet is discharged.

Nevertheless, if a recording sheet conveyed in the reverse direction along the sheet feed guide is not properly guided to a position between the feed roller and the recording sheets in the feed tray, sheet jamming may occur.

In known printing devices, the topmost recording sheet placed in the feed tray is moved in a direction opposite to the conveying direction. This prevents the topmost recording sheet from being fed along with the recording sheet guided by the sheet feed guide. Nevertheless, because the recording sheet guided by the sheet feed guide and the recording sheet disposed directly below the topmost recording sheet contact each other, these recording sheets may be fed together to the conveying path. A sheet conveying device used as document conveying means in a scanner has a similar problem. In particular, a document conveyed in the reverse direction may become jammed, or a document placed in a feed tray or document tray may be fed along with the document conveyed in the reverse direction.

SUMMARY OF THE INVENTION

Accordingly, in view of the above-described problems, it is an object of the present invention to provide a sheet conveying device that reduces the occurrence of jamming of a sheet conveyed in the reverse direction, and that may prevent feeding of a sheet in a feed tray along with the sheet conveyed in the reverse direction. It is another object of the present invention to provide a duplex recording device including the sheet conveying device.

An embodiment of the invention describes a sheet conveying device comprising a feed tray configured to store a plurality of sheets, a first conveying path configured to convey a first sheet of the plurality of sheets in a first direction, a feed roller configured to contact the sheets in the feed tray and to feed the first sheet to the first conveying path, a second conveying path connected to the first conveying path and to the feed tray, and configured to convey the first sheet in a second direction, wherein the second direction is substantially opposite to the first direction, a multiple feed guide disposed in the second conveying path and comprising a guide portion configured to guide the first sheet conveyed in the second conveying path to a position between the feed roller and the feed tray, and an overlying portion, disposed on at least one side of the feed roller in an axial direction, and configured to overlie the feed tray. The feed roller is further configured to feed the first sheet that was fed to the first conveying path and was guided by the multiple feed guide, back to the first conveying path.

In another embodiment of the invention, a duplex recording device comprises a sheet conveying device comprising a feed tray configured to store a plurality of sheets, a first conveying path configured to convey a first sheet of the plurality of sheets in a first direction, a feed roller configured to contact the sheets in the feed tray and to feed the first sheet to the first conveying path, a second conveying path connected to the first conveying path and to the feed tray, and configured to convey the first sheet in a second direction, wherein the second direction is substantially opposite to the first direction, and a multiple feed guide disposed in the second conveying path, and comprising a guide portion configured to guide the first sheet conveyed in the second conveying path to a position between the feed roller and the feed tray and an overlying portion disposed on at least one side of the feed roller in an axial direction, and configured to overlie the feed tray, a recording unit disposed in the first conveying path, and configured to record an image onto the first sheet being conveyed in the first conveying path, a discharge tray disposed above the feed tray, and a path changing unit disposed at a downstream side of the recording unit in the first conveying path and configured to alternately convey the first sheet to one of the discharge tray and the second conveying path. The feed roller is further configured to feed the first sheet that was fed to the first conveying path, and was guided by the multiple feed guide, back to the first conveying path.

DETAILED DESCRIPTION OF EMBODIMENTS

For a more complete understanding of the invention, the needs satisfied thereby, and the objects, features, and advantages thereof, reference now is made to the following description taken in connection with the accompanying drawings.

Figure 1:
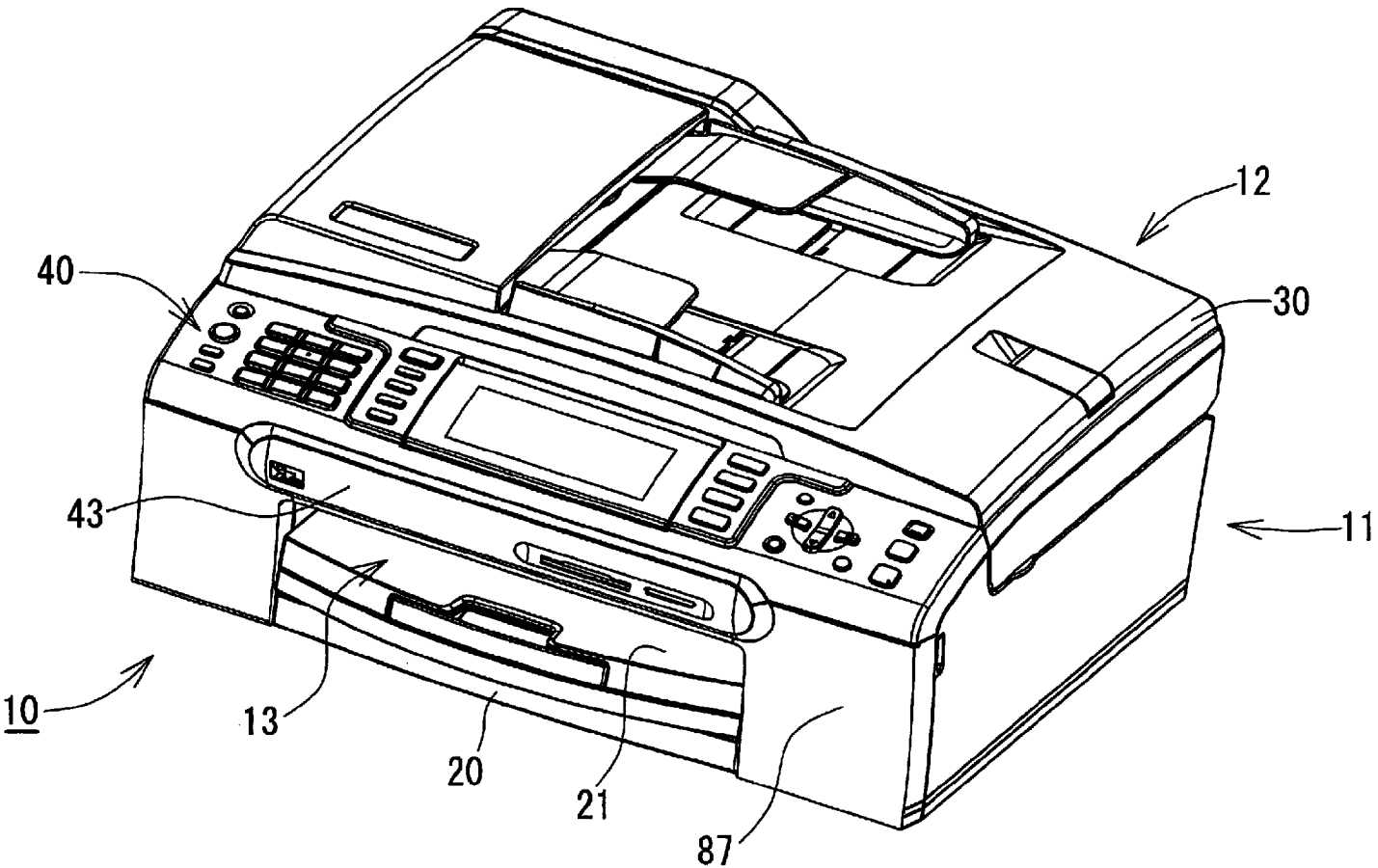
FIG. 1 is a perspective view of an external structure of a multi-function device according to an embodiment of the invention.

FIG. 1 is a perspective view of an external structure of a duplex recording device, e.g., multi-function device 10, according to an embodiment of the present invention. Multi-function device 10 may have a printing unit 11 at a lower portion thereof, and a scanning unit 12 at an upper portion thereof. Multi-function device 10 may have multiple functions, e.g., a printing function, a scanning function, a copying function, and a facsimile function. Printing unit 11 may be a printer, e.g., an inkjet printer, to which a sheet conveying device may be mounted. Printing unit 11 may be configured to convey a recording sheet in a manner corresponding to the sheet conveying device according to an embodiment of the invention. Accordingly, functions other than the printing function are not described in detail here. In an embodiment described herein, the sheet conveying device according to the present invention may be mounted to printing unit 11. Nevertheless, in other embodiments, the sheet conveying device may be applied to scanning unit 12, e.g., as an automatic document feeder (ADF) that conveys a document that is read at scanning unit 12.

As shown in FIG. 1, multi-function device 10 may have a low-profile shape, and may have a width and a depth that are greater than its height. Multi-function device 10 may have a substantially rectangular, parallelepiped form. The upper portion of multi-function device 10 may correspond to scanning unit 12. Scanning unit 12 may comprise a flat bed scanner (FBS) and an automatic document feeder (ADF). As shown in FIG. 1, a document cover 30 may be disposed at a front cover of multi-function device 10 and may be configured to be opened and closed. The ADF may be disposed at the document cover 30. A platen glass (not shown) and an image sensor (not shown) may be disposed at the lower side of document cover 30. At scanning unit 12, the image sensor may read a document on the platen glass or a document conveyed by the ADF. The operation of scanning units is well known, and a detailed description of the operation of scanning unit 12 is omitted.

An operation panel 40 may be disposed at the upper portion of the front side of multi-function device 10 and may be configured to operate printing unit 11 and scanning unit 12. Operation panel 40 may comprise a display, e.g., a liquid crystal display (LCD), which may display various information, and input keys, which may be used to input information. Multi-function device 10 may operate based on input received from operation panel 40. In addition, multi-function device 10 may operate based on information that is transmitted from an outside source, e.g., a computer that is connected to multi-function device 10 via a network or other communications device, e.g., a LAN or a direct cable.

Multi-function device 10 may be disposed with a slot unit 43, which may be configured to receive and read memory cards. For example, when a user operates operation panel 40 while a memory card is loaded in the slot unit 43, image data stored in the memory card may be read out and recorded onto a recording sheet.

Figure 2:
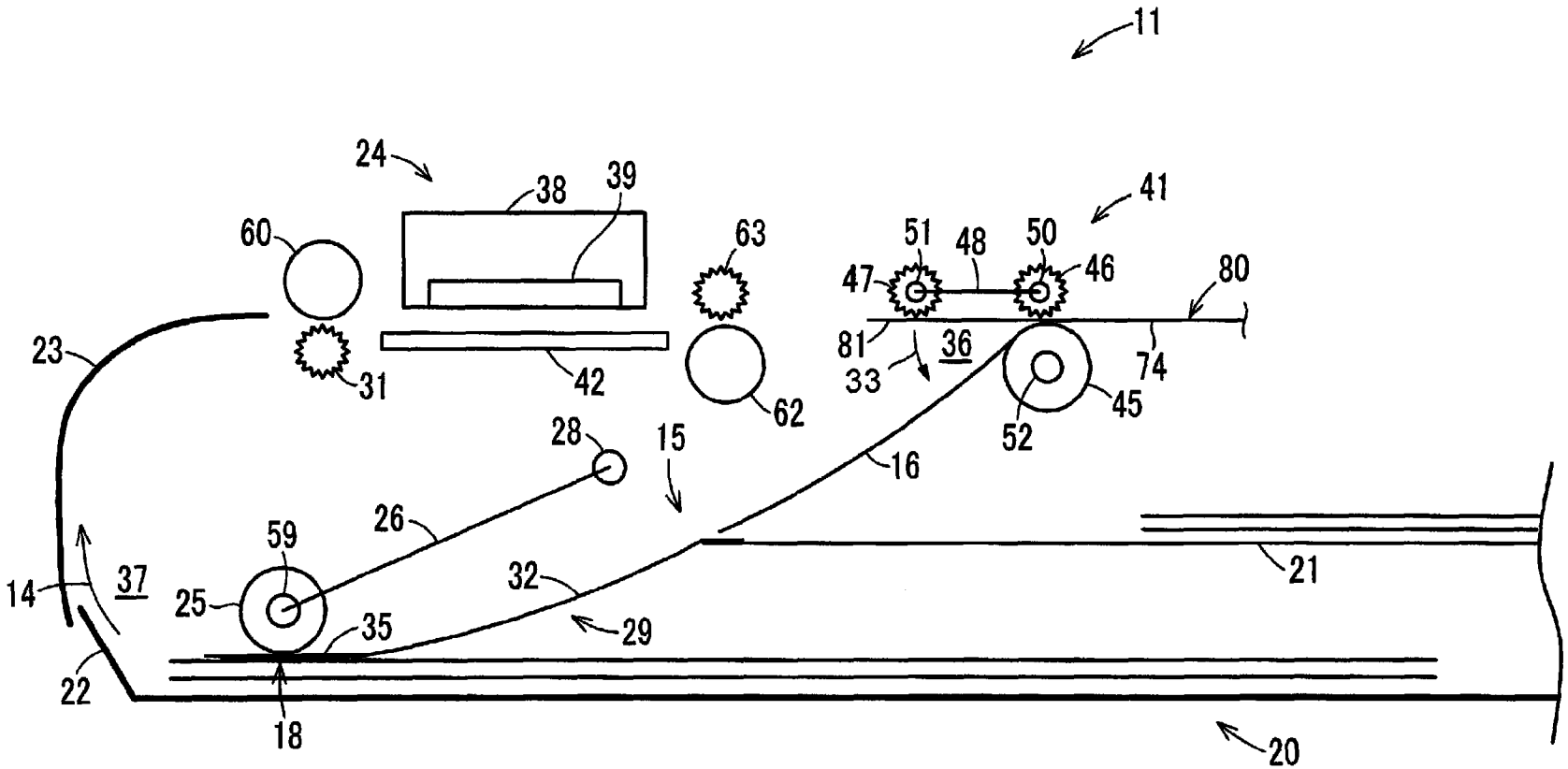
FIG. 2 is a schematic view of a structure of a printing unit according to an embodiment of the invention.

An internal structure of multi-function device 10, in particular, a structure of printing unit 11 is described herein. As shown in FIG. 1, a door 87 may be disposed at the lower right portion of the front side of printing unit 11, and configured to be opened and closed. A cartridge mount (not shown) may be disposed at the inner side of door 87. When door 87 is opened, the cartridge mount may be exposed at the front side of printing unit 11, which may allow an ink cartridge to be mounted and dismounted. As shown in FIG. 2, mounting the ink cartridge to the cartridge mount may cause an inkjet recording head 39 to be connected to the ink cartridge through an ink tube. Referring again to FIG. 1, in printing unit 11, ink supplied from the ink cartridge may be discharged onto a recording sheet by inkjet recording head 39, such that an image may be recorded onto the recording sheet.

As shown in FIG. 1, an opening 13 may be formed in the front side of printing unit 11. A first tray, e.g., feed tray 20, and a second tray, e.g., discharge tray 21, may be disposed in opening 13. Feed tray 20 and discharge tray 21 may be disposed vertically in two layers, and discharge tray 21 may be disposed above feed tray 20.

As shown in FIGS. 1 and 2, recording sheets may be placed in feed tray 20. Feed tray 20 may be disposed at the bottom of printing unit 11. The recording sheets in feed tray 20 may be fed into printing unit 11. As shown in FIG. 2, an inclined plate 22 may be disposed at the back side, e.g., the left side, when multi-function device 10 is disposed as shown in FIG. 2, of feed tray 20. Inclined plate 22 may be inclined towards the back side of the device. Inclined plate 22 may separate the topmost recording sheet from the rest of the sheets in feed tray 20, and may guide the topmost sheet upwards.

A first conveying path 23 may be disposed above inclined plate 22. First conveying path 23 may be a path for conveying the recording sheet, and may have an arcuate portion. First conveying path 23 may extend upwards from inclined plate 22, and then may curve towards the front side, e.g., the right side, when multi-function device 10 is disposed as shown in FIG. 2. First conveying path 23 then may extend towards the front side, may pass by a recording unit 24, and may be connected to discharge tray 21. The recording sheet in feed tray 20 may reverse direction, e.g., perform a U-turn upwards along first conveying path 23 and may reach recording unit 24. Then, recording unit 24 may record an image onto the recording sheet, and the recorded recording sheet may be discharged to discharge tray 21.

Figure 3:
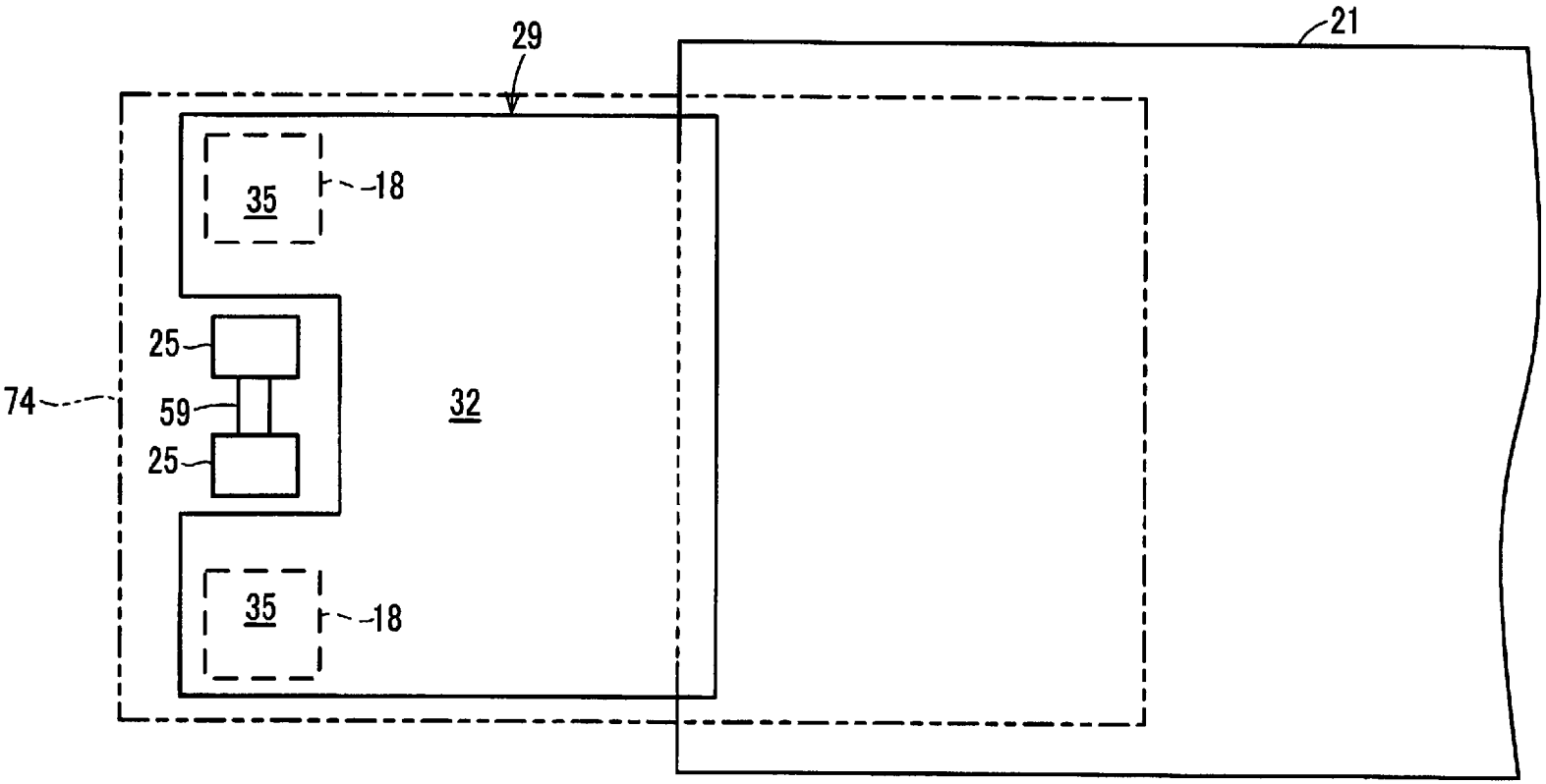
FIG. 3 is a schematic view of a structure of a multiple feed guide, and shows the relationship between the position of a guide portion and overlying portions, according to an embodiment of the invention.

As shown in FIG. 2, feed rollers 25 may be disposed above feed tray 20. Feed rollers 25 may press-contact the recording sheets in feed tray 20, and feed the topmost recording sheet to first conveying path 23. As shown in FIG. 2, feed rollers 25 may be rotatably supported at an end of an arm 26. As shown in FIG. 3, the feed rollers 25 may be disposed on both sides of a shaft 59, which may support feed rollers 25. Feed rollers 25 may be rotationally driven by a driving source, e.g., a motor (not shown).

Arm 26 may be supported at a pivot 28. This may allow arm 26 to swing about a pivotal center, e.g., pivot 28, in a direction in which arm 26 moves closer to or away from feed tray 20. Arm 26 may be pivotally biased towards feed tray 20 by a force, e.g., the force of its own weight or a force applied by an urging member, e.g., a spring. Arm 26 may be configured to retract by pivoting upward when feed tray 20 is inserted into or removed from opening 13.

Because arm 26 may be pivotally biased towards feed tray 20, feed rollers 25 may contact, e.g., press-contact, the recording sheets in feed tray 20. As shown in FIG. 2, in this state, feed rollers 25 may be rotationally driven in a clockwise direction. This may cause the topmost recording sheet in feed tray 20 to move towards inclined plate 22. An end of the recording sheet may contact inclined plate 22, and then may be guided upwards and into first conveying path 23 in the direction of arrow 14. When the topmost recording sheet is sent out by feed rollers 25, recording sheet disposed directly below the topmost recording sheet also may be sent out due to friction or static electricity. Inclined plate 22 may contact and restrain this recording sheet.

As shown in FIG. 2, recording unit 24 may be disposed in first conveying path 23, and may record an image onto the recording sheet that is conveyed in first conveying path 23. Recording unit 24 may comprise a carriage 38 and inkjet recording head 39 which may be mounted to carriage 38. Carriage 38 may be configured to reciprocate in a main scanning direction, e.g., in a direction perpendicular to a plane formed by the sheet of FIG. 2. Ink may be supplied to inkjet recording head 39 through the ink tube from the ink cartridge. Very small ink droplets may be discharged from inkjet recording head 39 while carriage 38 reciprocates. This may cause an image to be recorded onto the recording sheet conveyed on a platen 42. Although the recording method of recording unit 24 described in this embodiment is an inkjet recording method, other embodiments of this invention are not limited to an inkjet recording method and may use other recording methods, e.g., an electrophotography method.

As shown in FIG. 2, a conveying roller 60 may be disposed at an upstream side in a recording-sheet conveying direction (hereinafter interchangeably referred to as the "upstream side") of recording unit 24 in first conveying path 23. A pinch roller 31 may be disposed at a position opposing conveying roller 60, with first conveying path 23 being disposed between rollers 31 and 60. Pinch roller 31 may be biased so as to press-contact conveying roller 60. The recording sheet fed to first conveying path 23 may advance to a position between conveying roller 60 and pinch roller 31. Conveying roller 60 and pinch roller 31 may nip this recording sheet and rotate, which may send the recording sheet onto platen 42.

As shown in FIG. 2, a discharge roller 62 may be disposed at a downstream side in the recording-sheet conveying direction (hereinafter interchangeably referred to as the "downstream side") of recording unit 24 in first conveying path 23. A spur roller 63 may be disposed at a position opposing discharge roller 62, with first conveying path 23 being disposed between rollers 62 and 63. Spur roller 63 may be biased such that it press-contacts discharge roller 62, and may be configured to press-contact a printed side of the recording sheet. The surface of spur roller 63 may be uneven, which may prevent deterioration of the image recorded on the recording sheet. Discharge roller 62 and spur roller 63 may nip the recording sheet that has passed platen 42, and rotate, which may convey the recording sheet to a downstream portion 36.

Conveying roller 60 and discharge roller 62 may be driven by the motor (not shown) for driving feed rollers 25. Conveying roller 60 and discharge roller 62 may be synchronously and intermittently driven. The synchronous intermittent drive of conveying roller 60 and discharge roller 62 may cause the recording sheet to be fed by a predetermined line feed width. A rotary encoder (not shown) may be disposed at conveying roller 60. The rotary encoder may have an optical sensor configured to detect a pattern of an encoder disc (not shown) that may rotate with conveying roller 60. On the basis of a detection signal thereof, the rotation of conveying roller 60 and discharge roller 62 may be controlled.

In multi-function device 10, the motor may be a driving source for feeding the recording sheet to first conveying path 23 from feed tray 20, for conveying the recording sheet along first conveying path 23, and for discharging the recording sheet to discharge tray 21. The motor may drive feed rollers 25, and conveying roller 60 and discharge roller 62.

A second conveying path 15 may be connected to downstream portion 36 in first conveying path 23, and to feed tray 20. Second conveying path 15 may be a path for conveying a recording sheet 74, which may already have been conveyed in first conveying path 23, in the reverse direction, e.g., towards feed rollers 25 as shown in FIG. 2. As shown in FIG. 2, second conveying path 15 may be inclined, and may extend from downstream portion 36 towards feed rollers 25. A reverse guide 16 and a multiple feed guide 29 may be disposed in second conveying path 15.

The reverse guide may be connected to first conveying path 23, and may be formed continuously with a portion of first conveying path 23 situated at the downstream side of recording unit 24, e.g., with downstream portion 36. A path changing unit 41, which will be further described herein, may be disposed at downstream portion 36. Reverse guide 16 may comprise a reverse path for guiding recording sheet 74, which may have an image recorded on one side thereof, towards multiple feed guide 29. As shown in FIG. 2, reverse guide 16 may extend obliquely downward towards multiple feed guide 29 from downstream portion 36.

Multiple feed guide 29 may guide recording sheet 74 guided from reverse guide 16 to a position between feed rollers 25 and the topmost recording sheet in feed tray 20. Multiple feed guide 29 may be supported by discharge tray 21, and may extend obliquely downward towards feed rollers 25, from the lower end of reverse guide 16. Recording sheet 74, which may have been guided to multiple feed guide 29, again may be fed, to an upstream portion 37 in first conveying path 23, by feed rollers 25. Recording sheet 74 may be conveyed along first conveying path 23 in direction of arrow 14, to receive an image recorded by recording unit 24 on a side of recording sheet 74 which has not previously been recorded.

As shown in FIG. 2, path changing unit 41 may be disposed at the downstream side of recording unit 24 in first conveying path 23. More specifically, path changing unit 41 may be disposed at downstream portion 36, which may act as a boundary between first conveying path 23 and reverse guide 16. Path changing unit 41 may comprise pairs of rollers 45, 46 opposing each other and also may comprise auxiliary rollers 47 which may be disposed in parallel with rollers 46. Rollers 46 and auxiliary rollers 47 may be mounted to a frame 48. Frame 48 may extend in the widthwise direction of multi-function device 10, e.g., in a direction perpendicular to the sheet plane of FIG. 2.

Rollers 46 and auxiliary rollers 47 may be disposed at frame 48, at predetermined intervals in the widthwise direction of multi-function device 10. Rollers 46 and auxiliary rollers 47 may be supported by shafts 50 and 51, respectively, such that rollers 46 may be rotatable around shafts 50 and auxiliary rollers 47 may be rotatable around shafts 51. The axial directions of shafts 50 and 51 may be perpendicular to the sheet plane of FIG. 2. Since rollers 46 and auxiliary rollers 47 may come into contact with a recorded side 80 of recording sheet 74, they may have a spur shape, similar to the spur shape of spur roller 63. Auxiliary rollers 47 may be disposed a predetermined distance away from rollers 46 on an upstream side. Rollers 46 may be biased towards rollers 45 by an elastic member.

Rollers 45 may be rotated in the forward or reverse direction by the motor for driving feed rollers 25, conveying roller 60, and discharge roller 62. Rollers 45 may be connected to the motor through a predetermined drive transmission mechanism (not shown). Rollers 45 may have a center shaft 52, which may be connected to the drive transmission mechanism. A predetermined bracket may be disposed at center shaft 52, and may be fastened to a device frame with, a fastening member, e.g., a screw, such that center shaft 52 may be supported by the device frame.

Rollers 46 may be placed on rollers 45, and instead of rollers 45, a single, elongated, cylindrical roller may be used. Rollers 46 may be disposed such that rollers 46 and rollers 45 oppose each other. Rollers 45 may be rotated in the forward or reverse direction by the motor. Recording sheet 74 conveyed along first conveying path 23 may be nipped by rollers 45 and rollers 46. As shown in FIG. 1, when rollers 45 rotate in the forward direction, recording sheet 74 may be nipped by rollers 45 and rollers 46, may be conveyed downstream, and may be discharged to discharge tray 21. When rollers 45 rotate in the reverse direction, recording sheet 74 may be nipped by rollers 45 and rollers 46, and may be returned to the upstream side.

Figure 5A:
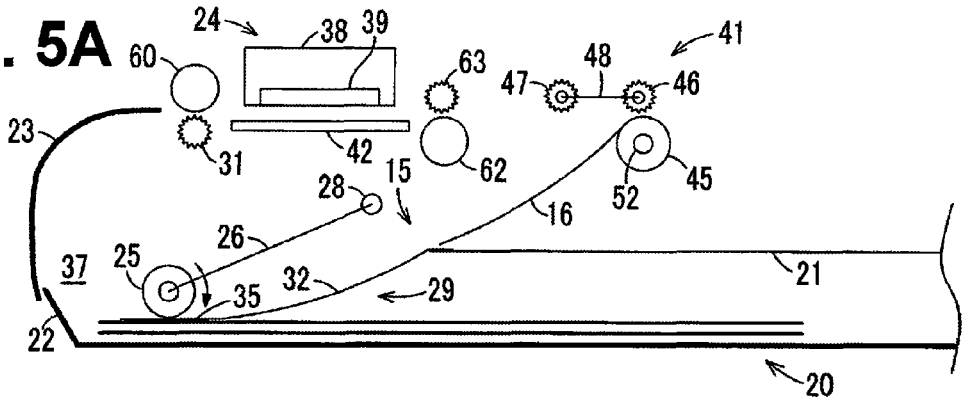
FIGS. 5A to 5D are schematic views showing duplex recording in the printing unit, according to an embodiment of the invention
Figure 5B:
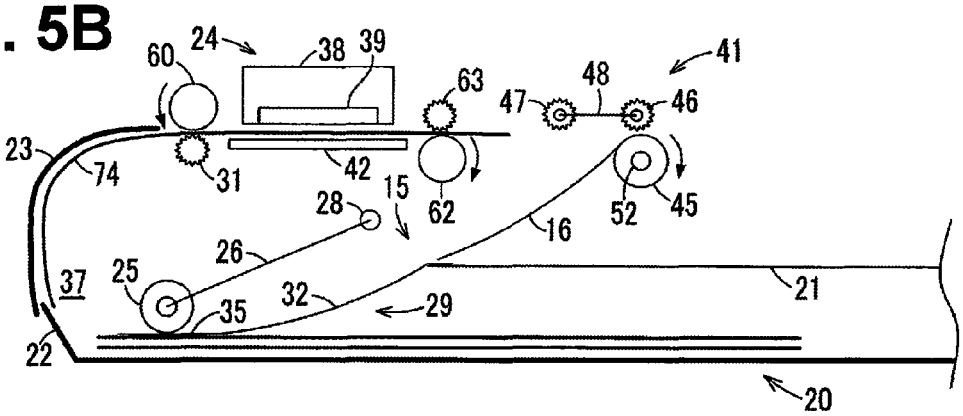
Figure 5C:
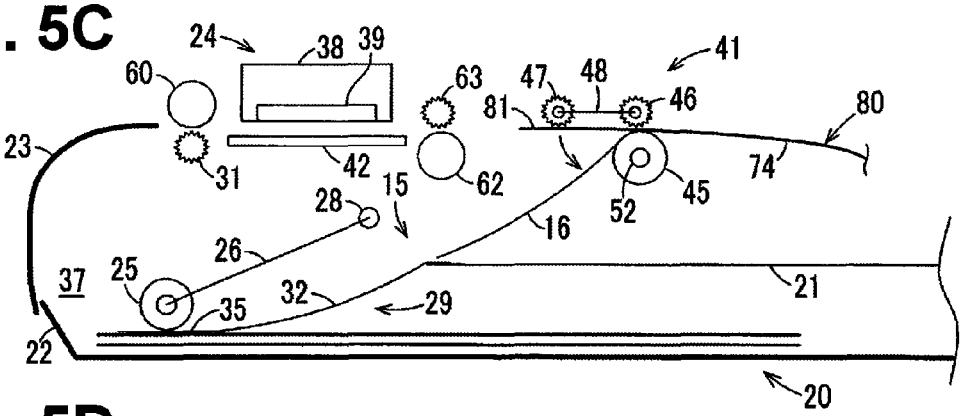
Figure 5D:
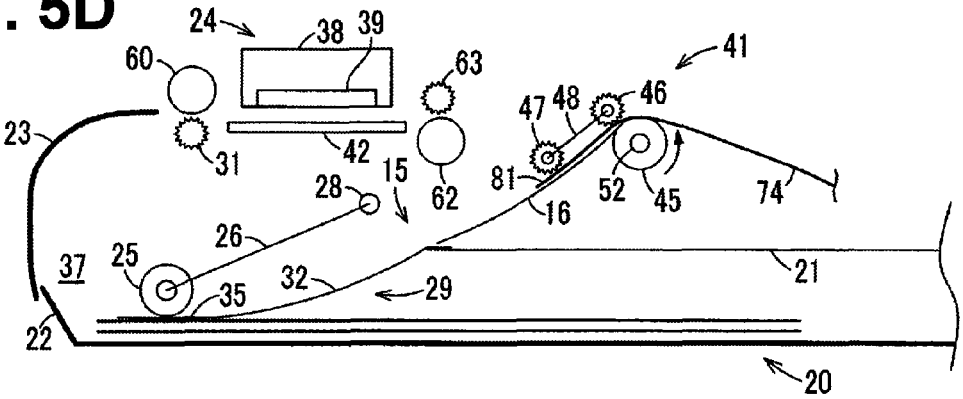

As shown in FIGS. 5C and 5D, path changing unit 41 may be formed such that frame 48, rollers 46, and auxiliary rollers 47 may rotate together in the direction of arrow 33, around center shaft 52. The motor may transmit a driving force which may cause path changing unit 41 to change its position between a first position and a second position. As shown in FIG. 2, when path changing unit 41 is in the first position, recording sheet 74 that has passed recording unit 24 may be discharged to discharge tray 21. When path changing unit 41 is in the second position, recording sheet 74 that has passed recording unit 24 may be conveyed in the reverse direction to second conveying path 15 through reverse guide 16, as shown in FIG. 5D.

Rollers 45 may be rotated in the forward direction by the motor, while path changing unit 41 may be maintained in the first position. In particular, rollers 45 may rotate clockwise when rollers 45 are in a state shown in FIG. 2. This rotation may cause recording sheet 74 that has passed recording unit 24 to be sent towards discharge tray 21, e.g., towards the right as shown in FIG. 2. While rollers 45 and rollers 46 nip a trail edge 81 of recording sheet 74, the position of path changing unit 41 may change from the first position to the second position. As shown in FIG. 5D, by this change in position, trailing edge 81 of recording sheet 74 may be pressed downward by auxiliary rollers 47. Rollers 45 may be rotated in the reverse direction by the motor while path changing unit 41 is maintained in the second position. In particular, rollers 45 may be rotated counterclockwise when the rollers are in the state shown in FIG. 5D. This reverse rotation may cause recording sheet 74 that has passed recording unit 24 to be guided towards reverse guide 16 from its trailing edge 81, and to be conveyed, in the reverse direction, to multiple feed guide 29. In this way, path changing unit 41 may cause recording sheet 74 conveyed through first conveying path 23 to be sent to discharge tray 21, or to second conveying path 15.

As shown in FIG. 3, which illustrates the relationship between the position of a guide portion 32 and overlying portions 35, multiple feed guide 29 may be formed of a film, and may have a substantially concave shape, when viewed in a plan view. Multiple feed guide 29 may comprise the substantially rectangular guide portion 32 and overlying portions 35, which may project towards inclined plate 22 from both sides of guide portion 32 in the widthwise direction, e.g., in the top-bottom direction when multi-function device 10 is disposed as shown in FIG. 3.

Multiple feed guide 29 may guide recording sheet 74, which may have been guided from reverse guide 16, to a position between feed rollers 25 and the recording sheets in feed tray 20. In particular, multiple feed guide 29 may guide recording sheet 74 to a position where the topmost recording sheet in feed tray 20 contacts feed rollers 25 (hereinafter interchangeably referred to as the "contact position"). Multiple feed guide 29 may be inclined such that it extends towards the contact position from an end of discharge tray 21 at the back side of the device. In addition, multiple feed guide 29 may be secured to the discharge tray on the side closest to reverse guide 16, e.g., the right side when multi-function device 10 is disposed as shown in FIG. 3. Multiple feed guide 29 may be disposed at discharge tray 21, such that an additional member for supporting multiple feed guide 29 may not be separately implemented. A side of multiple feed guide 29 closest to feed roller 25, e.g., the left side, when multi-function device 10 is disposed as shown in FIG. 3, may be left unsecured, and may be in contact with the recording sheets in feed tray 20, as shown in FIG. 2.

Multiple feed guide 29 may be elastically deformable, and may be formed of any suitable material, e.g., polyethylene terephthalate (PET). Therefore, one or more of the position, the orientation, or the shape of multiple feed guide 29 may be changed in accordance with the number of recording sheets in feed tray 20. Specifically, in an embodiment of the invention, the left side of multiple feed guide 29 may move vertically, which may cause multiple feed guide 29 to deform corresponding to the number of sheets in feed tray 20.

Guide portion 32 may guide recording sheet 74, that has been conveyed through first conveying path 23 and guided from reverse guide 16, to the contact position between feed rollers 25 and the recording sheets in feed tray 20. In multiple feed guide 29, guide portion 32 may be secured to discharge tray 21 with any suitable substance, e.g., an adhesive. Guide portion 32 may extend from discharge tray 21 to the vicinity of the contact position, such that guide portion 32 may avoid contact with feed rollers 25.

As shown in FIG. 2, guide portion 32 may be curved downwards. The curvature of the curved portion of guide portion 32 may change due to sliding of recording sheet 74. This may cause the angle at which recording sheet 74 enters the contact position to be substantially horizontal, such that trailing edge 81 of recording sheet 74 may be directed towards the contact position. Because recording sheet 74 may be smoothly guided to the contact position, jamming of recording sheet 74 may be reduced.

Overlying portions 35 may be disposed such that they extend from both sides of guide portion 32 in the widthwise direction, e.g., the top-bottom direction when multi-function device 10 is disposed as shown in FIG. 3, to a location that may be closer to inclined plate 22 than to feed rollers 25, as shown in FIG. 2. Overlying portions 35 may overlie the recording sheets in feed tray 20 at both sides of feed rollers 25 in the axial direction of feed rollers 25, e.g., the widthwise direction. A film 18 may be attached to the back side of each of overlying portions 35 that contact the topmost recording sheet in feed tray 20.

Film 18 may be a thin film formed of a suitable material, e.g., cork or rubber. Film 18 may be thin such that that a large gap may not be formed between recording sheet 74 conveyed in the reverse direction and the contact position. At both sides of feed rollers 25 in their axial direction, both sides of recording sheet 74 that have entered the contact position may not be not raised. The material of film 18 may be any material which has a coefficient of friction that is higher than that of the front surface, of overlying portion 35, that contacts recording sheet 74 conveyed in the reverse direction. By attaching film 18 to the back surface of overlying portion 35, the coefficient of friction of the back surface of overlying portion 35 that contacts the topmost recording sheet in feed tray 20 may be higher than that of the front surface of overlying portion 35 that contacts recording sheet 74 conveyed in the reverse direction.

As long as the coefficient of friction of the back surface of overlying portion 35 is made higher than that of the front surface of overlying portion 35, film 18 may be unattached to overlying portion 35. For example, the coefficient of friction of the front surface of overlying portion 35 may be made lower than that of the back surface of overlying portion 35 by forming an uneven front surface in overlying portion 35. Alternatively, the front surface of overlying portion 35 may be formed using a first material, and the back surface of overlying portion 35 may be formed using a material whose coefficient of friction is higher than that of the first material. In another embodiment of the invention, an image may be recorded on the front surface of overlying portion 35 such that its coefficient of friction becomes lower than that of the back surface of overlying portion 35.

Figure 4A:
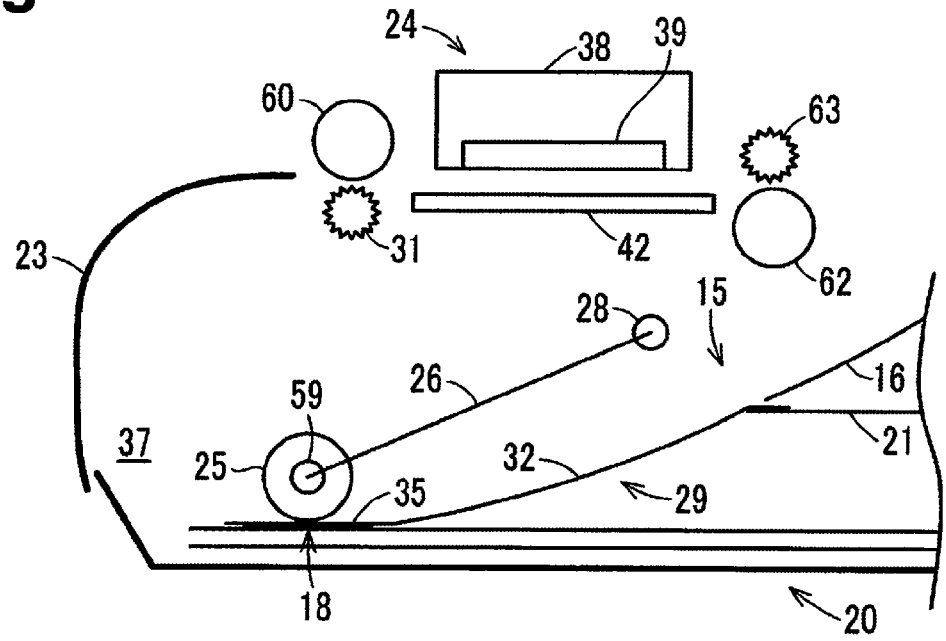
FIGS. 4A and 4B are schematic views of the multiple feed guide that changes its position and orientation in accordance with the number of recording sheets in a feed tray, according to an embodiment of the invention.
Figure 4B:
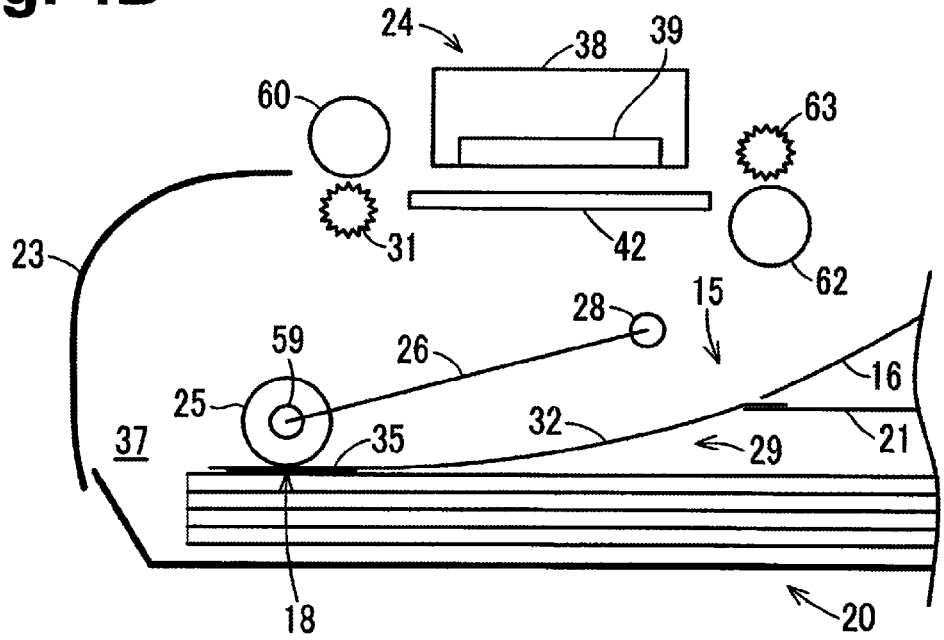

As shown in FIGS. 4A and 4B, feed rollers 25 may be disposed at an end of swingable arm 26. Therefore, when, as shown in FIGS. 4A and 4B, the number of recording sheets in feed tray 20 changes, the height of feed rollers 25 also may change accordingly. In other words, the height of the contact position may change corresponding to the number of recording sheets in feed tray 20. Multiple feed guide 29 may be elastically deformable as mentioned above, and may change its position and orientation corresponding to the number of recording sheets in feed tray 20. Nevertheless, the direction of recording sheet 74 guided by guide portion 32 remains towards the contact position, regardless of the number of recording sheets in feed tray 20. In addition, overlying portions 35 may remain disposed on both sides of feed rollers 25 in the axial direction of feed rollers 25. Thus, regardless of the number of recording sheets in feed tray 20, it may be possible to reduce jamming of recording sheet 74 conveyed in the reverse direction, and to prevent feeding the topmost recording sheet 74 in feed tray 20 along with recording sheet 74 conveyed in the reverse direction.

FIGS. 5A to 5D and FIGS. 6A to 6D are schematic views showing duplex recording in printing unit 11, according to an embodiment of the invention. Feed rollers 25 may contact the topmost recording sheet in feed tray 20. As shown in FIGS. 2 and 3, when an instruction to start printing is given by a predetermined operation on the operation panel 40, driving force may be transmitted from the motor to shaft 59. As shown in FIGS. 5A and 5B, this may cause feed rollers 25 to be rotationally driven, such that the topmost recording sheet may be fed from feed tray 20 to first conveying path 23.

The recording sheet fed to first conveying path 23 may be conveyed along first conveying path 23 by conveying roller 60 and pinch roller 31, and discharge roller 62 and spur roller 63. An image may be recorded onto one side of the recording sheet by recording unit 24 as the recording sheet is conveyed on platen 42. This recording sheet, e.g., recording sheet 74, may be conveyed to path changing unit 41 from recording unit 24. Path changing unit 41 may be maintained in the first position, and in this state, rollers 45 and rollers 46 may rotate in the forward direction. When single-side printing is set, recording sheet 74, having the image recorded on one side, may be conveyed downstream by rollers 45 and rollers 46, and may be discharged to discharge tray 21 from first conveying path 23.

In the duplex recording mode, rollers 45 and rollers 46 may rotate in the forward direction, while path changing unit 41 may be maintained in the first position. This may cause recording sheet 74, which has the image recorded on one side, to be conveyed towards discharge tray 21. Then, when trailing edge 81 of recording sheet 74 reaches a predetermined position that may be situated at an upstream side of the auxiliary rollers 47, e.g., the state shown in FIG. 5C, path changing unit 41 may change its position from the first position to the second position, as shown in FIGS. 5C and 5D. Trailing edge 81 of recording sheet 74 may be pressed downward by auxiliary rollers 47, and may be oriented towards reverse guide 16, as shown in FIG. 5D.

Figure 6A:
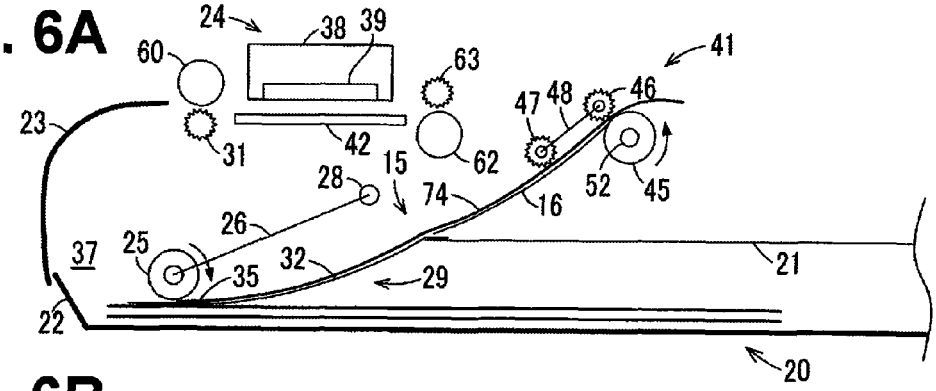
FIGS. 6A to 6D are schematic views further showing the duplex recording in the printing unit, according to an embodiment of the invention.

Reverse rotation of rollers 45 and rollers 46 may cause the conveying direction of recording sheet 74 to be changed, such that recording sheet 74 may be conveyed in the reverse direction to reverse guide 16 and multiple feed guide 29, as shown in FIGS. 5D and 6A. Recording sheet 74 may be guided to guide portion 32 of multiple feed guide 29, and may be conveyed to the contact position. When trailing edge 81 of recording sheet 74 reaches a position between feed rollers 25 and the recording sheets in feed tray 20, the feed rollers 25 may be rotationally driven. This may cause recording sheet 74 to be conveyed from multiple feed guide 29 to the upstream side of recording unit 24 in first conveying path 23, e.g., towards upstream portion 37. This may cause recording sheet 74 to flip over.

Figure 6B:
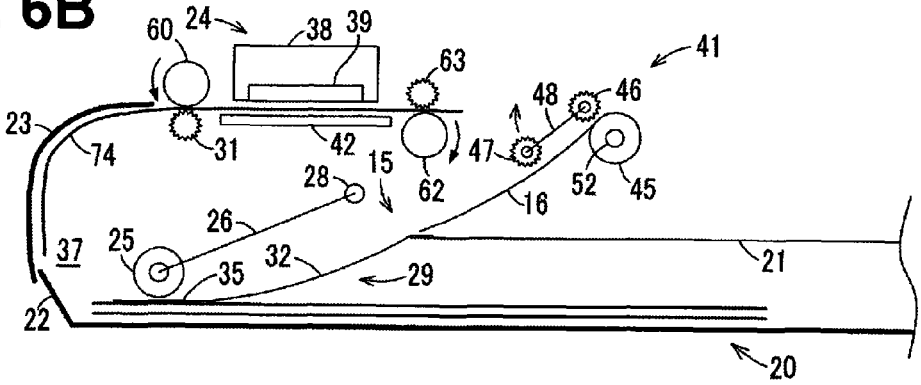
Figure 6C:
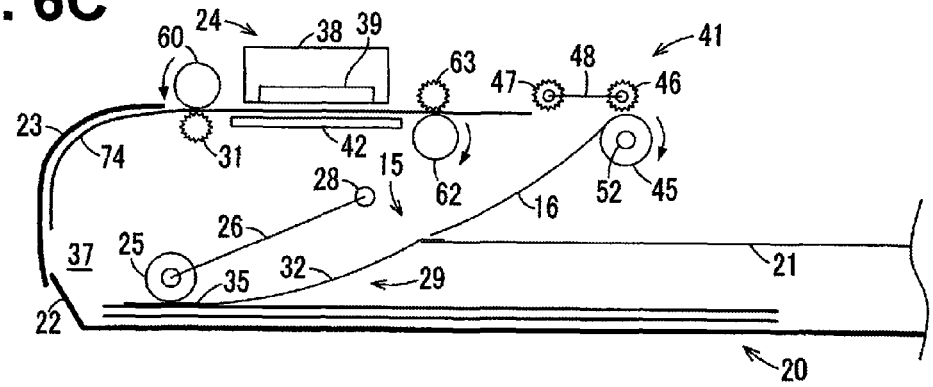
Figure 6D:
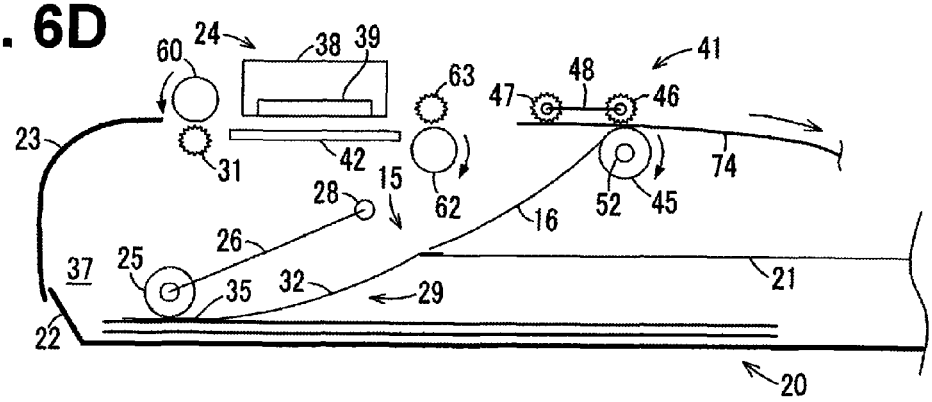

In particular, when recording sheet 74 is conveyed to platen 42, the side of recording sheet 74 opposite to the recorded side may oppose inkjet recording head 39. When recording sheet 74 is conveyed on platen 42, an image may be recorded on the other side, e.g., the side opposite to recorded side 80. When recording sheet 74 is conveyed from multiple feed guide 29 to first conveying path 23, the position of path changing unit 41 may change from the second position to the first position, as shown in FIGS. 6B and 6C. Recording sheet 74, having the images recorded on both sides, may be discharged from first conveying path 23 to discharge tray 21 by the forward rotation of rollers 45 and 46, as shown in FIG. 6D.

When such duplex recording is performed, recording sheet 74, conveyed in the reverse direction in second conveying path 23, again may be fed to first conveying path 23 by feed rollers 25, with a large portion of recording sheet 74 out of contact with the topmost recording sheet in feed tray 20, due to overlying portions 35. Therefore, recording sheet 74, conveyed in the reverse direction, may slide smoothly along multiple feed guide 29, without a large frictional force being produced between recording sheet 74 and the topmost recording sheet in feed tray 20. As a result, it may be possible to prevent unintentional feeding of the topmost recording sheet in feed tray 20 when recording sheet 74 is conveyed in the reverse direction.

In another embodiment, multiple feed guide 29 may be elastically deformable, and recording sheet 74, conveyed in the reverse direction and guided to guide portion 32, may cause multiple feed guide 29 to flex, e.g., deform. Therefore, multiple feed guide 29 further may be curved. This may increase the contact area between overlying portions 35 and the topmost recording sheet in feed tray 20. As a result, overlying portions 35 may restrain the topmost recording sheet in feed tray 20 more effectively, such that double-feeding of the topmost recording sheet in feed tray 20 and recording sheet 74 that again is fed to first conveying path 23, may be prevented.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. A sheet conveying device comprising:

a feed tray configured to store a plurality of sheets;

a first conveying mechanism comprising a first conveying roller and configured to convey a first sheet that is a topmost sheet of the plurality of sheets in a first direction along a first conveying path such that a second sheet below the first sheet becomes the topmost sheet of the plurality of sheets;

a second conveying mechanism comprising a second conveying roller and configured to convey the first sheet in a second direction along a second conveying path which is connected to the first conveying path and to the feed tray, wherein the second direction is substantially opposite to the first direction;

a feeding mechanism comprising a feed roller and configured to move such that the feed roller contacts the first sheet at a contact position overlying the feed tray, feeds the first sheet from the feed tray to the first conveying path, and feeds the first sheet from the second conveying path again to the first conveying path; and a multiple feed guide disposed in the second conveying path and comprising:

a guide portion configured to guide the first sheet conveyed along the second conveying path to the contact position; and an overlying portion disposed on at least one side of the feed roller in an axial direction and configured to contact the topmost sheet of the plurality of sheets at a more downstream position in the second direction than the contact position, and to move vertically corresponding to a number of the plurality of sheets in the feed tray without contacting the feeding mechanism.

2. The sheet conveying device according to claim 1, wherein the overlying portion comprises a pair of overlying portions disposed on both sides of the feed roller in the axial direction.

3. The sheet conveying device according to claim 1, wherein the first conveying mechanism further comprises an arcuate portion configured to contact the first sheet, thereby reversing the direction of the first sheet.

4. The sheet conveying device according to claim 1, wherein the feeding mechanism comprises an arm configured to swing about a predetermined pivot, and wherein the feed roller is rotatably supported at an end of the arm.

5. The sheet conveying device according to claim 1, wherein a shape of the multiple feed guide is configured to change corresponding to the number of sheets in the feed tray.

6. The sheet conveying device according to claim 5, wherein the multiple feed guide is elastically deformable.

7. The sheet conveying device according to claim 1, wherein the overlying portion has a first surface configured to contact the first sheet guided by the guide portion and a second surface configured to contact the topmost sheet of the plurality of sheets in the feed tray, and wherein a coefficient of friction of the second surface is greater than a coefficient of friction of the first surface.

8. The sheet conveying device according to claim 7, wherein the second surface of the overlying portion is comprised of a film, and a coefficient of friction of the film is greater than the coefficient of friction of the first surface of the overlying portion.

9. The sheet conveying device according to claim 1, further comprising a discharge tray disposed above the feed tray, such that the feed tray and the discharge tray are arranged vertically in two layers.

10. The sheet conveying device according to claim 9, wherein the first sheet conveyed along the first conveying path is discharged into the discharge tray, and wherein the multiple feed guide is supported by the discharge tray.

11. The sheet conveying device according to claim 1, wherein the first sheet comprises a particular edge, and the first conveying mechanism is configured to convey the first sheet with the particular edge as a leading edge, and the second conveying mechanism is configured to convey the first sheet with the particular edge as a trailing edge.

12. The sheet conveying device according to claim 1, wherein the overlying portion of the multiple feed guide is parallel to a top surface of the topmost sheet of the plurality of sheets in the feed tray.

13. A duplex recording device comprising:

a sheet conveying device comprising:

a feed tray configured to store a plurality of sheets;

a first conveying mechanism comprising a first conveying roller and configured to convey a first sheet that is a topmost sheet of the plurality of sheets in a first direction along a first conveying path such that a second sheet below the first sheet becomes the topmost sheet of the plurality of sheets;

a second conveying mechanism comprising a second conveying roller and configured to convey the first sheet in a second direction along a second conveying path that is connected to the first conveying path and to the feed tray, wherein the second direction is substantially opposite to the first direction;

a feeding mechanism comprising a feed roller and that is configured to move such that the feed roller contacts the first sheet at a contact position overlying the feed tray, feeds the first sheet from the feed tray to the first conveying path, and feeds the first sheet from the second conveying path again to the first conveying path; and a multiple feed guide disposed in the second conveying path and comprising:

a guide portion configured to guide the first sheet conveyed along the second conveying path to the contact position; and an overlying portion disposed on at least one side of the feed roller in an axial direction and configured to contact the topmost sheet of the plurality of sheets at a more downstream position in the second direction than the contact position, and to move vertically corresponding to a number of the plurality of sheets in the feed tray without contacting the feeding mechanism;

a recording unit disposed in the first conveying path, and configured to record an image onto the first sheet being conveyed in the first conveying path;

a discharge tray disposed above the feed tray; and a path changing unit disposed at a downstream side of the recording unit in the first conveying path and configured to alternately convey the first sheet to one of the discharge tray and the second conveying path.

14. The duplex recording device according to claim 13, wherein the recording unit is configured to record the image onto one side of the first sheet when the first sheet is fed to the first conveying path and to record the image onto an opposite side of the first sheet when the first sheet is fed again to the first conveying path by the feed roller.

15. The duplex recording device according to claim 14, wherein the path changing unit is configured to convey the first sheet with the image recorded on one side thereof to the second conveying path.

16. The duplex recording device according to claim 14, wherein the path changing unit is configured to convey the first sheet with the image recorded on both sides thereof to the discharge tray.

* * * * *